US008193729B2

(12) United States Patent
Liao

(10) Patent No.: US 8,193,729 B2
(45) Date of Patent: Jun. 5, 2012

(54) WIRELESS REMOTE CONTROL SYSTEM AND METHODS FOR MONITORING AND CONTROLLING ILLUMINATING DEVICES

(76) Inventor: Yun-Chang Liao, Renwu Township, Kaohsiung County (TW)

( * ) Notice: Subject to any disclaimer, the term of this patent is extended or adjusted under 35 U.S.C. 154(b) by 359 days.

(21) Appl. No.: 12/607,160

(22) Filed: Oct. 28, 2009

(65) Prior Publication Data

US 2011/0074312 A1 Mar. 31, 2011

(30) Foreign Application Priority Data

Sep. 30, 2009 (TW) ..... 98133209 A

(51) Int. Cl.
*H05B 37/02* (2006.01)

(52) U.S. Cl. ..... 315/291; 315/294

(58) Field of Classification Search ..... 315/291, 315/312–325
See application file for complete search history.

(56) References Cited

U.S. PATENT DOCUMENTS 6,521,879 B1 * 2/2003 Rand et al. ..... 250/205
6,548,967 B1 * 4/2003 Dowling et al. ..... 315/318
7,120,560 B2 * 10/2006 Williams et al. ..... 702/188
2002/0145394 A1 * 10/2002 Morgan et al. ..... 315/291
2007/0085700 A1 * 4/2007 Walters et al. ..... 340/870.02
2007/0291483 A1 * 12/2007 Lys ..... 362/227
2008/0147337 A1 * 6/2008 Walters et al. ..... 702/64

* cited by examiner

*Primary Examiner* — Douglas W Owens
*Assistant Examiner* — Amy Yang
(74) *Attorney, Agent, or Firm* — Alan Kamrath; Kamrath IP Lawfirm, PA

(57) ABSTRACT

A system includes first and second illuminating devices respectively having different first and second identification numbers indicative of locations and/or serial numbers of the illuminating devices. A parameter of one of voltage, temperature, resistance, and power of a lighting unit of each illuminating device is detected. The parameter and the identification number of each illuminating device are encoded into a packet. The second illuminating device receives the packet of the first illuminating device and sends the packets of the first and second illuminating devices to a control center. The control center decodes the packets and judges operational states of the illuminating devices based on the parameters detected. A control signal is sent by the control center to turn on or off or control brightness of at least one of the illuminating devices when at least one of the illuminated devices is judged as operating abnormally after judging the parameters detected.

16 Claims, 4 Drawing Sheets

WIRELESS REMOTE CONTROL SYSTEM AND METHODS FOR MONITORING AND CONTROLLING ILLUMINATING DEVICES

BACKGROUND OF THE INVENTION

The present invention relates to a wireless remote control system and methods for monitoring and controlling illuminating devices and, more particularly, to a wireless remote control system and methods for monitoring and controlling illuminating devices such as road lamps or the like utilized in public areas such as roads, parks, etc.

Public areas such as roads and parks are generally provided with illuminating devices such as road lamps to provide illumination in the night or in rainy or foggy days. Systems for detecting operation of the illuminating devices by wire or wireless connection have been utilized to save labor and to quickly find problems of the illuminating devices. These systems generally include sensors for detecting a parameter such as voltage, electric current, circuit, brightness, or temperature of the illuminating devices, and sending a signal indicative of the parameter to a control center including built-in programs to judge whether the illuminating devices are operating normally. Maintenance personnel can be sent immediately when abnormal operation or malfunction of the illuminating devices is detected. However, these systems only offer detection of on/off and malfunction of the illuminating devices. The illuminating devices are in a full-load state by increasing the voltage or current in a period of time after they are turned on, which is a waste of energy, because the illuminating devices do not have to always be in the full-load state due to various reasons. As an example, people are less willing to go out after midnight in the winter than in the summer. Furthermore, the illuminating devices could not provide the required illumination when they are damaged or deteriorate. Further, the illuminating devices often provide light beams of a certain color, which is not always suitable in various situations. As an example, white light beams provide less illuminating effect than yellow light beams.

Thus, a need exists for a novel system and methods for monitoring and controlling brightness and colors of beams emitted by illuminating devices.

BRIEF SUMMARY OF THE INVENTION

The present invention solves this need and other problems in the field of control of illuminating devices by providing, in a first aspect, a wireless remote control system including a first illuminating device having a first microprocessor and a first lighting unit electrically connected to and controlled by the first microprocessor. A first memory is electrically connected to the first microprocessor and has a first identification number indicative of at least one of a location and a serial number of the first illuminating device. A first detection unit is electrically connected to the first microprocessor and the first lighting unit. The first detection unit detects a first parameter of one of voltage, temperature, resistance, and power of the first lighting unit in operation and sends the detected first parameter to the first microprocessor. The first microprocessor encodes the first parameter and the first identification number into a first packet. A first wireless transmitting unit includes a first signal transmitter sending out a first signal containing the first packet. A second illuminating device is spaced from the first illuminating device and includes a second microprocessor. A second lighting unit is electrically connected to and controlled by the second microprocessor. A second memory is electrically connected to the second microprocessor and has a second identification number indicative of at least one of a location and a serial number of the second illuminating device. The second identification number is different from the first identification number. A second detection unit is electrically connected to the second microprocessor and the second lighting unit. The second detection unit detects a second parameter of one of voltage, temperature, resistance, and power of the second lighting unit in operation and sends the detected second parameter to the second microprocessor. The second microprocessor encodes the second parameter and the second identification number into a second packet. A second wireless transmitting unit includes a signal receiver and a second signal transmitter. The signal receiver receives the first signal containing the first packet from the first illuminating device. The second signal transmitter sends out the first signal and a second signal containing the second packet. A network device receives and transmits the first and second signals to a control center. The control center decodes the first and second packets and judges operational states of the first and second illuminating devices based on the first and second parameters detected. The control center sends out a control signal through the network device to turn on or off or control brightness of at least one of the first and second illuminating devices when at least one of the first and second parameters is identified as not in a normal range.

According to a second aspect of the present invention, a method is provided for remotely monitoring and controlling first and second illuminating devices. The first illuminating device is provided with a first identification number indicative of at least one of a location and a serial number of the first illuminating device. The first illuminating device includes a first microprocessor and a first lighting unit electrically connected and controlled by the first microprocessor. The second illuminating device is provided with a second identification number indicative of a location of the second illuminating device. The second identification number is different from the first identification number. The second illuminating device includes a second microprocessor and a second lighting unit electrically connected to and controlled by the second microprocessor. A first parameter of one of voltage, temperature, resistance, and power of the first lighting unit in operation is detected. The first parameter and the first identification number are encoded by the first microprocessor into a first packet. A second parameter of one of voltage, temperature, resistance, and power of the second lighting unit in operation is detected. The second parameter and the second identification number are encoded by the second microprocessor into a second packet. The first packet is sent to the second illuminating device. The first and second packets are sent from the second illuminating device to a control center via a network device. The control center decodes the first and second packets and judges operational states of the first and second illuminating devices based on the first and second parameters detected. A control signal is sent by the control center through the network device to turn on or off or control brightness of at least one of the first and second illuminating devices when at least one of the first and second illuminated devices is judged as operating abnormally after judging the first and second parameters detected.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
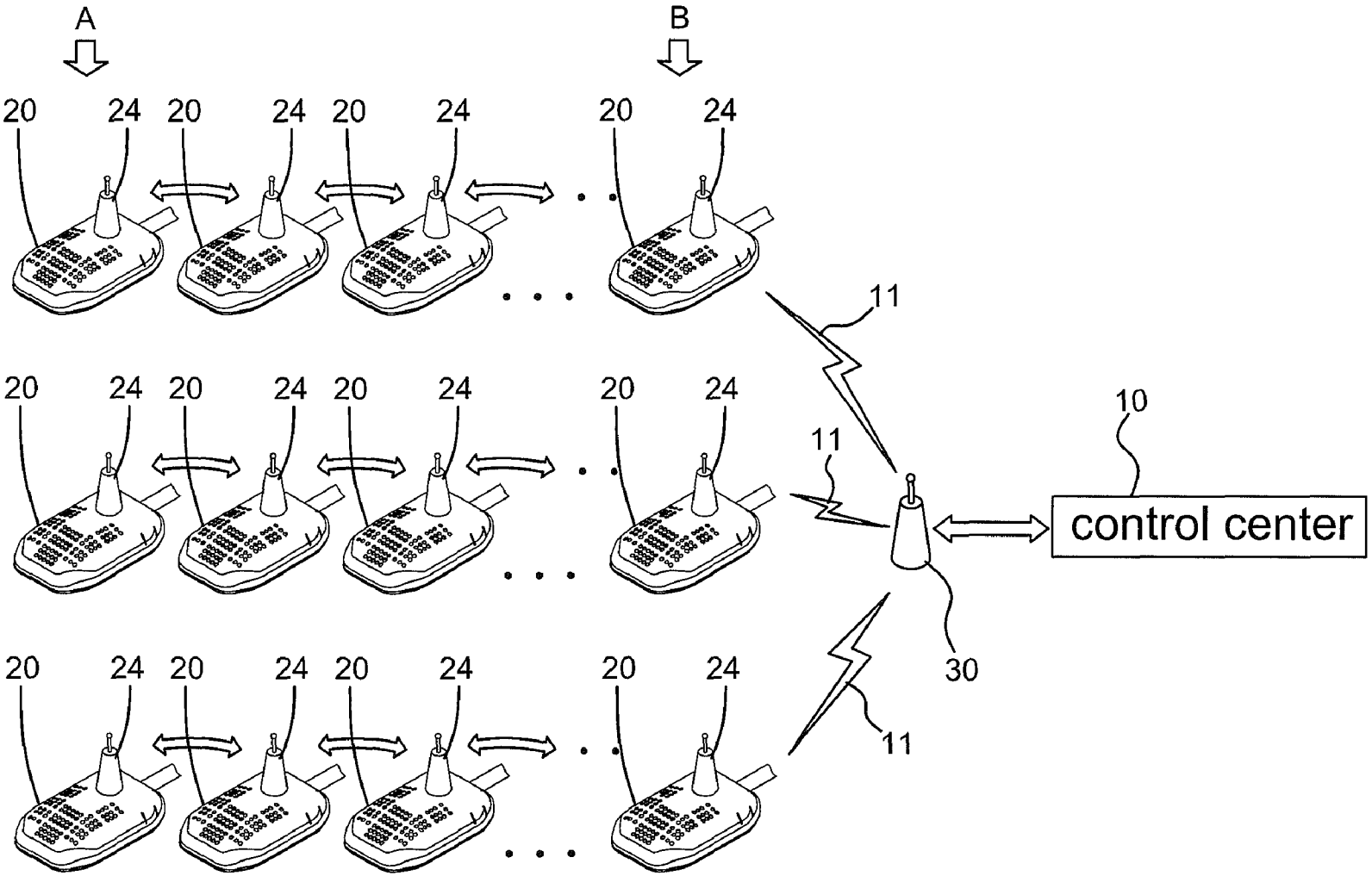
FIG. 1 shows a diagrammatic diagram of a wireless remote control system and methods for monitoring and controlling illuminating devices according to the preferred teachings of the present invention.
Figure 2:
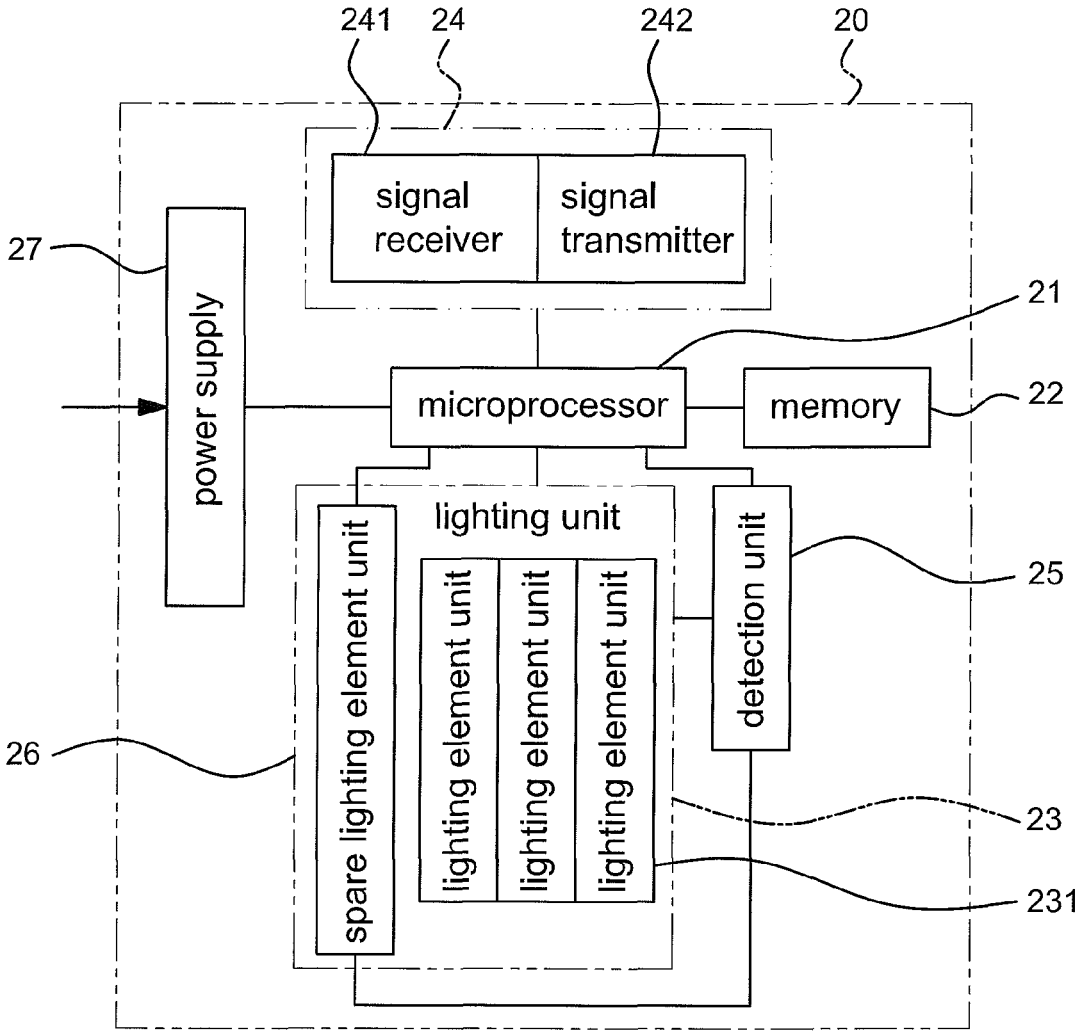
FIG. 2 shows a schematic block diagram of an illuminating device according to the preferred teachings of the present invention.
Figure 3:
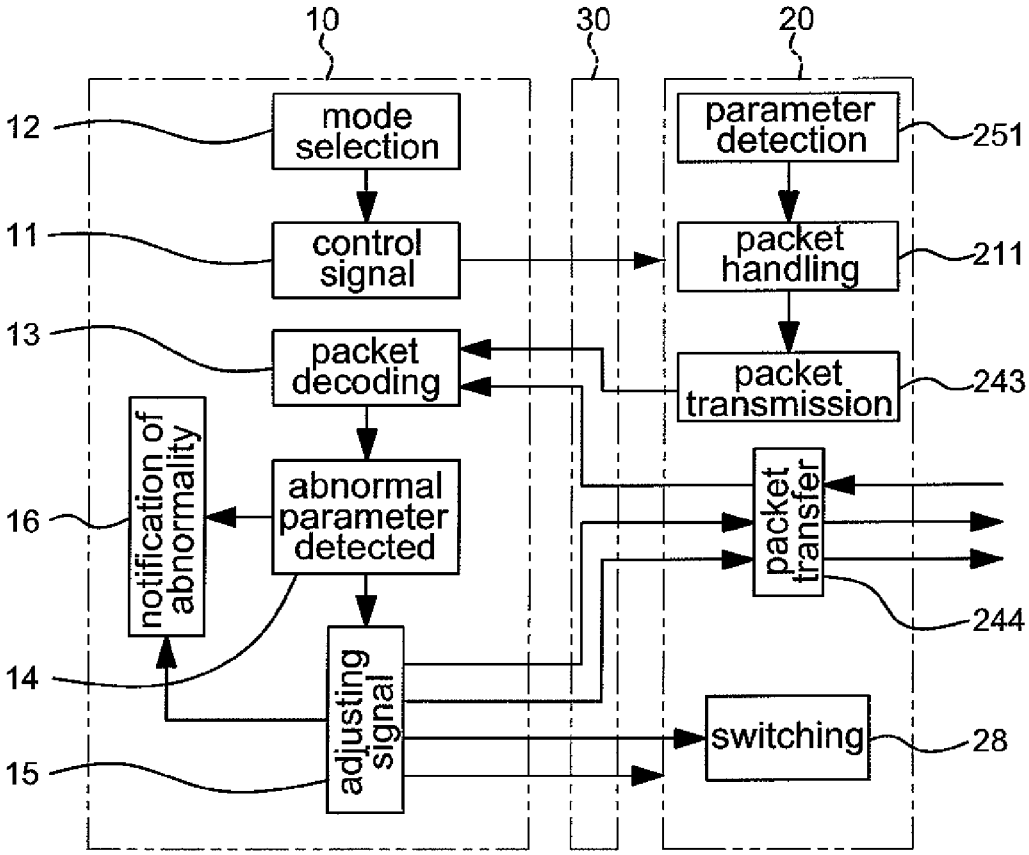
FIG. 3 shows a schematic block diagram of the illuminating device of FIG. 2, a control center, and a network device according to the preferred teachings of the present invention.
Figure 4:
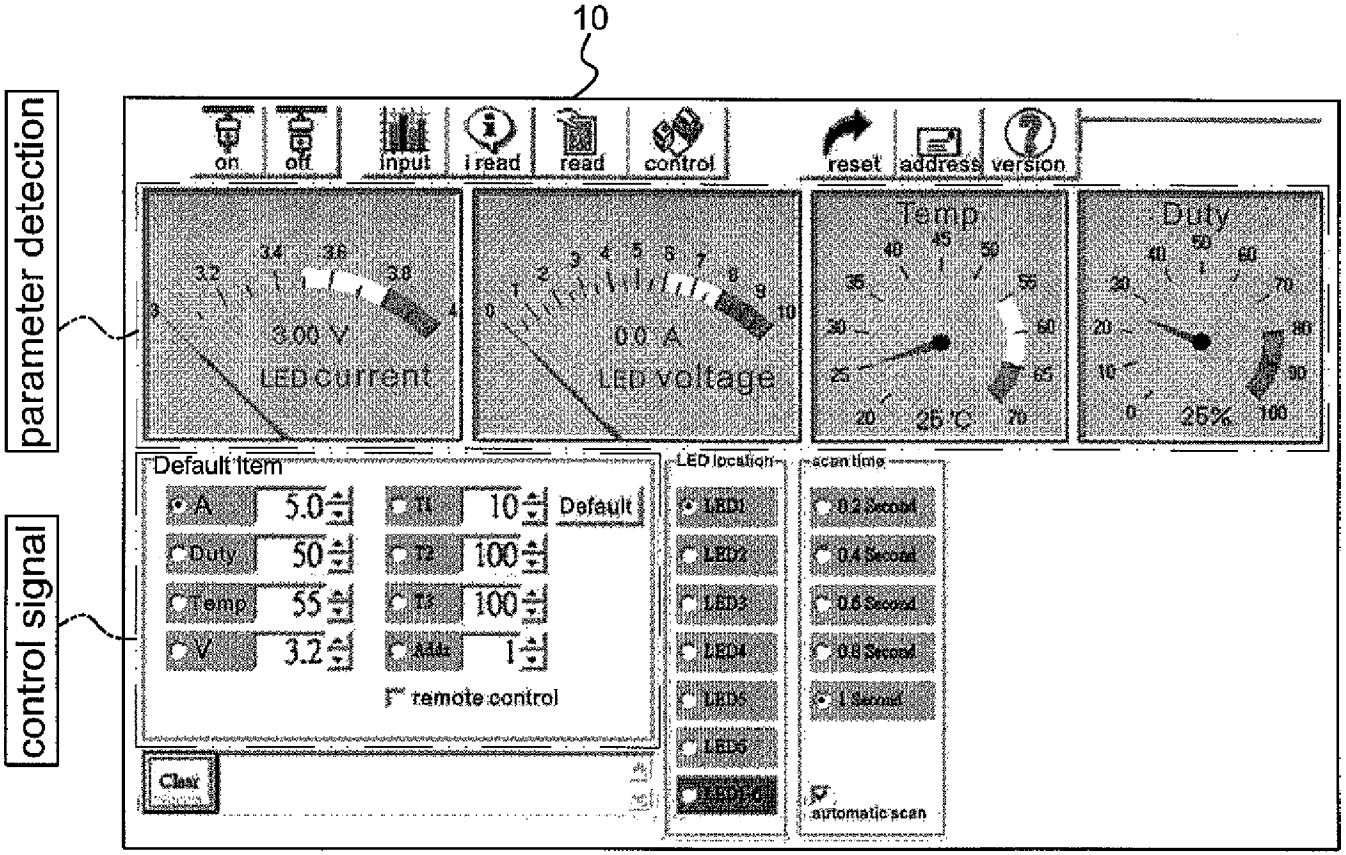
FIG. 4 shows a control panel of the control center according to the preferred teachings of the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "last", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A wireless remote control system according to the preferred teachings of the present invention is shown in the drawings and generally includes a control center 10, a plurality of groups of illuminating devices 20, and a network device 30 providing interconnection between control center 10 and illuminating devices 20. Each illuminating device 20 includes a microprocessor 21, a memory 22 electrically connected to microprocessor 21, a lighting unit 23 electrically connected to and controlled by microprocessor 21, a wireless transmitting unit 24 electrically connected to microprocessor 21, a detection unit 25 electrically connected to lighting unit 23 and microprocessor 21, and a power supply 27 electrically connected to microprocessor 21 and an external power system. Power supply 27 supplies lighting unit 23 with electricity for lighting purposes.

Memory 22 of each illuminating device 20 includes an identification number indicative of at least one of a location and a serial number of illuminating device 20. As an example, a first one of a group of illuminating devices 20 is given an identification number 0001,1011 with "0001" indicating the assigned serial number and with "1011" indicating the location of the first illuminating device 20. Likewise, a second one of another group of illuminating devices 20 can be given an identification number 0002,1112 with "0002" indicating the assigned serial number and with "1112" indicating the location of the second illuminating device 20. Thus, all of illuminating devices 20 have different identification numbers. It can be appreciated that the last four digits indicating the location of illuminating device 20 can be separated into two or more groups to allow users to rapidly locate the exact position of illuminating device 20. Other methods or systems for identifying the locations and serial numbers of illuminating devices 20 can be utilized in the present invention. Control center 10 can include a map including the locations of illuminating devices 20. Illuminating devices 20 can be located on the map, so that the exact positions of illuminating devices 20 operating abnormally can be easily identified on the map.

Lighting unit 23 of each illuminating device 20 includes a plurality of lighting element units 231 and a spare lighting element unit 26. When illuminating device 20 is activated, microprocessor 21 controls lighting element units 231 to emit light beams for illumination purposes. Spare lighting element unit 26 is turned off when lighting element units 231 operate normally. On the other hand, spare lighting element unit 26 is turned on when one or more lighting element units 231 operate abnormally or are damaged. Lighting element units 231 of each illuminating device 20 are serially connected light-emitting diodes capable of emitting light beams of one or more colors (such as white, yellow, or both) under control of microprocessor 21. Likewise, spare lighting element unit 26 can be a light-emitting diode capable of emitting light beams of one or more colors (such as white, yellow, or both) under control of microprocessor 21.

Detection unit 25 of each illuminating device 20 detects a parameter (such as voltage, temperature, resistance, power, etc.) of each of lighting element units 231 and spare lighting element unit 26 of lighting unit 23. The parameter detected is sent to microprocessor 21. As an example, detection unit 25 can detect each of lighting element units 231 and spare lighting element unit 26 per 0.2-5 seconds. Each time microprocessor 21 receives the detected parameter, the detected parameter and the identification number are encoded into a packet by microprocessor 21. Furthermore, microprocessor 21 can control brightness of lighting unit 23 by outputting differing currents, voltages, or powers.

Wireless transmitting unit 24 of each illuminating device 20 includes a signal receiver 241 and a signal transmitter 242. The packet encoded by microprocessor 21 is transmitted by signal transmitter 242 via wireless technology such as WIFI (802.15.4/Zigbee protocol or 802.11x protocol), GPRS (general packet radio service), Bluetooth, etc. Bluetooth technology is utilized in the most preferred form shown. Wireless transmitting unit 24 of the first one (indicated by A in FIG. 1) of each group of illuminating devices 20 does not have to include signal receiver 241. The packet of the first illuminating device 20 in a group of illuminating devices 20 is received by signal receiver 241 of the second illuminating device 20 of the same group, which will identify whether the packet received belongs to its group. If yes, the second illuminating device 20 transmits the packet of the first illuminating device 20 to the third illuminating device 20 of the same group. Furthermore, the second illuminating device 20 transmits its own packet to the third illuminating device 20. The procedure continues until the last illuminating device 20 (indicated by B in FIG. 1) receives the packets of the other illuminating devices 20 of the same group. The last illuminating device 20 transmits the all of the packets (including its own) of the same group to control center 10 via network device 30. Network device 30 can be ADSL (asymmetric digital subscriber line), WIFI (802.15.4/Zigbee protocol or 802.11x protocol), GPRS (general packet radio service), HSDPA (high speed downlink packet access), WiMAX (worldwide interoperability for microwave access), or other suitable technology.

As an example, each of lighting element units 231 and spare lighting element unit 26 includes 6 to 8 light-emitting diodes with a power of 3 W. The light-emitting diodes of each of lighting element units 231 and spare lighting element unit 26 are connected in series. When one of the light-emitting diodes is damaged or operates abnormally, the remaining light-emitting diodes are not affected, although the total resistance will be increased. In an example in which the light-emitting diodes of lighting element units 231 operate at 3.2 volts and 5 amperes, control center 10 can output a control signal (a voltage, current or power) to turn on lighting element units 231. In addition to regular detection with the normal range of the parameter under normal operating operations, control center 10 can also create other parameters or operational conditions such as calculating the normal resistance (R=V/I) or controlling the working temperature not to exceed 55□ (such as operation in summer mode and at a fixed current) or controlling the output to be equal to 80% or 90% of the maximum power. Detection is carried out by control center 10 through detection unit 25 of each illuminating device 20. Since the current of power supply 27 is maintained at 5 amperes, the voltage of lighting element units 231 will be increased according to Ohm's Law when one or more light-emitting diodes of lighting element units 231 are damaged. Thus, damage of light-emitting diodes of lighting element units 231 can be identified by control center 10 based on the increase in the voltage (or abnormal change in the resistance, power, or temperature). Thus, the associated illuminating device 20 including the damaged light-emitting diodes will be identified as damaged.

The system according to the teachings of the present invention can operate by a method according to the teachings of the present invention and is believed to provide synergistic results. Specifically, according to the method according to the teachings of the present invention, a control signal 11 can be sent from control center 10 through network device 30 to turn on or off illuminating devices 20. Lighting units 23 of illuminating devices 20 can be of uniform brightness (100%, 90%, 80%, etc) and emit light beams of the same or different colors.

On the other hand, control signal 11 can be generated through mode selection 12 to control on/off of illuminating devices 20. In the preferred form shown, the system according to the teachings of the present invention includes seven operational modes: spring, summer, fall, winter, rain, fog, snow, and full load (duty). Each mode is separated into a plurality of time periods. The brightnesses of illuminating devices 20 can be varied in different time periods (due to differing activities of people, sunshine, environments, etc.) as well as in different seasons. As an example, the brightness of illuminating devices 20 from 11 PM to 1 AM in a spring day may be 90% of the maximum brightness while the brightness of illuminating devices 20 from 11 PM to 1 AM in a winter day may be 80% of the maximum brightness. In another example, in a snowy day, the brightness from 11 PM to 1 AM can be adjusted to be 70% of the maximum brightness, for the white snow can reflect light. Thus, through mode selection 12, the brightnesses of illuminating devices 20 required in a period of time during which less outdoor activities of people are involved can be reduced to save energy.

Table 1 shows an example of settings of brightnesses in differing time periods and in differing operation modes.

TABLE 1

| | mode | | | | | | | |
|---|---|---|---|---|---|---|---|---|
| time | spring | summer | fall | winter | rain | fog | snow | full load |
| 5-6 PM | — | — | 80% | 90% | 100% | 100% | 100% | 100% |
| 6-7 PM | 100% | 100% | 100% | 100% | 100% | 100% | 100% | 100% |
| 7-9 PM | 100% | 100% | 100% | 100% | 100% | 100% | 100% | 100% |
| 9-11 PM | 95% | 100% | 95% | 95% | 100% | 100% | 90% | 100% |
| 11 PM-1 AM | 90% | 95% | 90% | 80% | 100% | 100% | 70% | 100% |
| 1-3 AM | 75% | 90% | 80% | 75% | 100% | 100% | 70% | 100% |

TABLE 1-continued

| | mode | | | | | | | |
|---|---|---|---|---|---|---|---|---|
| time | spring | summer | fall | winter | rain | fog | snow | full load |
| 3-5 AM | 80% | 85% | 85% | 85% | 100% | 100% | 70% | 100% |
| 5-6 AM | 90% | 80% | 90% | 95% | 100% | 100% | 95% | 100% |
| 6-7 AM | — | — | 80% | 80% | 100% | 100% | 80% | 100% |
| 7 AM-5 PM | — | — | — | — | 90% | 90% | 80% | 100% |

Regardless of mode selection 12, illuminating devices 20 begin to operate after receiving control signal 11. Detection unit 25 of each illuminating device 20 proceeds parameter detection 251. Encoding of the detected parameter and the identification number of illuminating device 20 into a packet (packet handling 211), receiving a packet from a previous illuminating device 20 and transmission of the packet of the previous illuminating device 20 together with its own packet to the next illuminating device 20 (packet transmission 243 and packet transfer 244) are carried out until the packets of all of illuminating devices 20 are sent via network device 30 to control center 10, as mentioned above.

After receiving the packets of all of illuminating devices 20, control center 10 decodes the packets and judges whether each detected parameter is in a normal operational range (packet decoding 13). If an abnormal parameter is detected (see 14), control center 10 sends out an adjusting signal 15 through network device 30. Adjusting signal 15 contains a control parameter signal and an identification number of an abnormally operating illuminating device 20. Adjusting signal 15 is received by each illuminating device 20 that will identify the identification numbers contained in adjusting signal 15. If the identification number contained in adjusting signal 15 does match the identification number of this illuminating device 20, no action will be made, and this illuminating device 20 simply passes adjusting signal 15 to the next illuminating device 20. On the other hand, when the abnormally operating illuminating device 20 receives the adjusting signal 15, the control parameter signal will be used to reduce or increase the current to keep the abnormally operating illuminating device 20 running, and the parameter of the abnormally operating illuminating device 20 in operation will be detected by its detection unit 25 and encoded again together with its identification number into a packet (packet decoding 13), which is sent back to control center 10 to identify whether this illuminating device 20 still operates abnormally. If the abnormal parameter is still detected, control center 10 will send out a notification of abnormality 16 or switch lighting element units (see 28) by turning on spare lighting element units 26.

In a case that the parameter is the temperature, and the temperature detected is higher than the threshold (such as 55° C.), control center 10 will send notification of abnormality 16 to maintenance personnel. The maintenance personnel can readily learn the exact location of the damaged or malfunctioning illuminating device 20 on the map. Rapid repair can, thus, be made. In another case that the parameter is voltage, and the voltage detected is higher than the threshold, control center 10 will judge which lighting element unit 231 of lighting unit 23 of the damaged or malfunctioning illuminating device 20 operates abnormally. Adjusting signal 15 is then sent out to proceed switching of lighting elements (see 28) including turning off the lighting element unit 231 that operates abnormally and turning on spare lighting element unit 26, so that this illuminating device 20 can operate normally. Each illuminating device 20 keeps sending packets to control center 10.

The present invention allows easy identification of an illuminating device 20 that operates abnormally by judging a parameter and an identification number. Furthermore, the identification number allows maintenance personnel to rapidly locate and repair the abnormally operating illuminating device 20. Further, mode selection 12 allows illuminating device 20 to lower the brightnesses in time periods during which outdoor activities of people are not often. Energy can, thus, be saved. Provision of spare illuminating devices 26 in lighting units 23 allows illuminating devices 20 to operate normally to reduce the frequency of maintenance while maintaining the brightnesses.

Now that the basic teachings of the present invention have been explained, many extensions and variations will be obvious to one having ordinary skill in the art. For example, the number of illuminating devices 20 of the wireless remote control system according to the preferred teachings of the present invention can be varied according to needs. Furthermore, the packet of each illuminating device 20 can be sent to control center 10 via an already constructed city network system.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A wireless remote control system comprising, in combination:

a first illuminating device including:

a first microprocessor, a first lighting unit electrically connected to and controlled by the first microprocessor, a first memory electrically connected to the first microprocessor and having a first identification number indicative of at least one of a location and a serial number of the first illuminating device, a first detection unit electrically connected to the first microprocessor and the first lighting unit, with the first detection unit detecting a first parameter of one of voltage, temperature, resistance, and power of the first lighting unit in operation and sending the detected first parameter to the first microprocessor, with the first microprocessor encoding the first parameter and the first identification number into a first packet, and a first wireless transmitting unit including a first signal transmitter sending out a first signal containing the first packet;

a second illuminating device spaced from the first illuminating device, with the second illuminating device including:

a second microprocessor, a second lighting unit electrically connected to and controlled by the second microprocessor, a second memory electrically connected to the second microprocessor and having a second identification number indicative of at least one of a location and a serial number of the second illuminating device, with the second identification number being different from the first identification number, a second detection unit electrically connected to the second microprocessor and the second lighting unit, with the second detection unit detecting a second parameter of one of voltage, temperature, resistance, and power of the second lighting unit in operation and sending the detected second parameter to the second microprocessor, with the second microprocessor encoding the second parameter and the second identification number into a second packet, and a second wireless transmitting unit including a signal receiver and a second signal transmitter, with the signal receiver receiving the first signal containing the first packet from the first illuminating device, with the second signal transmitter sending out the first signal and a second signal containing the second packet;

a network device receiving and transmitting the first and second signals; and a control center receiving the first and second signals from the network device, with the control center decoding the first and second packets and judging operational states of the first and second illuminating devices based on the first and second parameters detected, with the control center sending out a control signal through the network device to turn on or off or control brightness of at least one of the first and second illuminating devices when at least one of the first and second parameters is identified as not in a normal range, with each of the first and second lighting units including a plurality of lighting element units and a spare lighting element unit, with the plurality of lighting element units and the spare lighting element unit of each of the first and second lighting units being respectively controllable by the first and second microprocessors to control brightness of the first and second illuminating devices, with the spare lighting element unit of the first lighting unit being turned off when the plurality of lighting element units of the first lighting unit operates normally, with the spare lighting element unit of the first lighting unit being turned on when the plurality of lighting element units of the first lighting unit operates abnormally, with the spare lighting element unit of the second lighting unit being turned off when the plurality of lighting element units of the second lighting unit operates normally, and with the spare lighting element unit of the second lighting unit being turned on when the plurality of lighting element units of the second lighting unit operates abnormally, with each of the plurality of lighting element units and the spare lighting element units of the first and second illuminating devices including a plurality of serially connected light-emitted diodes and capable of emitting light beams of at least two different colors.

2. The wireless remote control system as claimed in claim 1, wherein when at least one of the plurality of lighting element units of the first and second illuminating devices operates abnormally, the control center sends out an adjusting signal to turn on the spare lighting element units of the first and second illuminating devices and to turn off said at least one of the plurality of lighting element units of the first and second illuminating devices that operates abnormally.

3. The wireless remote control system as claimed in claim 1, further comprising, in combination: a third illuminating device spaced from the first and second illuminating devices, with the third illuminating device including: a third microprocessor, a third lighting unit electrically connected to and controlled by the third microprocessor, a third memory electrically connected to the third microprocessor and having a third identification number indicative of at least one of a location and a serial number of the third illuminating device, with the third identification number different from the first and second identification numbers, a third detection unit electrically connected to the third microprocessor and the third lighting unit, with the third detection unit detecting a third parameter of one of voltage, temperature, resistance, and power of the third lighting unit in operation and sending the detected third parameter to the third microprocessor, with the third microprocessor encoding the third parameter and the third identification number into a third packet, and a third wireless transmitting unit including a second signal receiver and a third signal transmitter, with the second signal receiver receiving the first and second signals containing the first and second packets, with the third signal transmitter sending out the first and second signals and a third signal containing the third packet, with the network device transmitting the first, second, and third signals to the control center, with the control center decoding the third packet and judging operational states of the third illuminating device based on the third parameter detected, with the control center capable of sending out the control signal through the network device to open or close or control brightness of at least one of the first, second, and third illuminating devices when at least one of the first, second, and third parameters is identified as not in the normal range.

4. A method for remotely monitoring and controlling first and second illuminating devices comprising:

providing the first illuminating device with a first identification number indicative of at least one of a location and a serial number of the first illuminating device, with the first illuminating device including a first microprocessor and a first lighting unit electrically connected and controlled by the first microprocessor, providing the second illuminating device with a second identification number indicative of a location of the second illuminating device, with the second identification number being different from the first identification number, with the second illuminating device including a second microprocessor and a second lighting unit electrically connected to and controlled by the second microprocessor;

detecting a first parameter of one of voltage, temperature, resistance, and power of the first lighting unit in operation;

encoding the first parameter and the first identification number with the first microprocessor into a first packet;

detecting a second parameter of one of voltage, temperature, resistance, and power of the second lighting unit in operation;

encoding the second parameter and the second identification number with the second microprocessor into a second packet;

sending the first packet to the second illuminating device;

sending the first and second packets from the second illuminating device to a control center via a network device, with the control center decoding the first and second packets and judging operational states of the first and second illuminating devices based on the first and second parameters detected;

sending a control signal by the control center through the network device to turn on or off or control brightness of at least one of the first and second illuminating devices when at least one of the first and second illuminating devices is judged as operating abnormally after judging the first and second parameters detected; and providing the control center with a plurality of operational modes corresponding to different brightnesses of each of the first and second illuminating devices, with sending the control signal including sending the control signal containing one of the plurality of operational modes to at least one of the first and second microprocessors, with providing the control center with the plurality of operational modes including providing the control center with the plurality of operational modes according to weather conditions of the locations of the first and second illuminating devices.

5. The method as claimed in claim 4, with providing the control center with the plurality of operational modes including providing the control center with the plurality of operational modes according to brightness requirements in different time periods.

6. The method as claimed in claim 4, with each of the first and second lighting units having a plurality of lighting element units capable of emitting light beams of at least two different colors, with sending the control signal including sending the control signal according to the weather conditions of the locations of the first and second illuminating devices to control the plurality of lighting element units of the first and second lighting units to emit one of the at least two different colors according to the weather conditions.

7. The method as claimed in claim 6, with sending the control signal including sending the control signal to turn off damaged first and second illuminating devices and to increase the brightness of undamaged first and second illuminating devices according to the weather conditions.

8. The method as claimed in claim 7, with each of the first and second units including a spare lighting element unit, with sending the control signal including turning on the spare lighting element units when one or more of the plurality of lighting element units of the first and second lighting units are damaged.

9. The method as claimed in claim 8, further comprising: detecting the first and second parameters again; encoding the first parameter detected again and the first identification number into a third packet and sending the third packet to the second illuminating device; encoding the second parameter detected again and the second identification number into a fourth packet; sending the third and fourth packets to the control center to decode the third and fourth packets and judging the operational states of the first and second illuminating devices based on the first and second parameters detected again; and sending out an adjusting signal from the control center to at least one of the first and second illuminating devices to increase the brightness of at least one of the first and second lighting units when at least one of the first and second illuminated devices is judged as operating abnormally after judging first and second parameters detected again.

10. The method as claimed in claim 9, with sending out the adjusting signal including sending out the adjusting signal containing an identifying code corresponding to the first and second identification numbers to at least one of the first and second microprocessors, with the first microprocessor accepting the adjusting signal and adjusting brightness of the first illuminating device when the identifying code is identified to be the same as the first identification number, with the first microprocessor ignoring the adjusting signal when identifying code is identified to be not the same as the first identification number, with the second microprocessor accepting the adjusting signal and adjusting brightness of the second illuminating device when the identifying code is identified to be the same as the second identification number, with the second microprocessor ignoring the adjusting signal when identifying code is identified to be not the same as the second identification number.

11. The method as claimed in claim 4, with sending out the adjusting signal including sending out the adjusting signal containing an identifying code to at least one of the first and second microprocessors, with the first microprocessor accepting the adjusting signal and adjusting brightness of the first illuminating device when the identifying code is identified to be the same as the first identification number, with the first microprocessor ignoring the adjusting signal when identifying code is identified to be not the same as the first identification number, with the second microprocessor accepting the adjusting signal and adjusting brightness of the second illuminating device when the identifying code is identified to be the same as the second identification number, with the second microprocessor ignoring the adjusting signal when identifying code is identified to be not the same as the second identification number.

12. The method as claimed in claim 4, further comprising: providing a map including the locations of the first and second illuminating devices; and indicating at least one of the first and second illuminating devices that are not in normal operational states after judging the first and second parameters detected.

13. A method for remotely monitoring and controlling first and second illuminating devices comprising:

providing the first illuminating device with a first identification number indicative of at least one of a location and a serial number of the first illuminating device, with the first illuminating device including a first microprocessor and a first lighting unit electrically connected and controlled by the first microprocessor, providing the second illuminating device with a second identification number indicative of a location of the second illuminating device, with the second identification number being different from the first identification number, with the second illuminating device including a second microprocessor and a second lighting unit electrically connected to and controlled by the second microprocessor;

detecting a first parameter of one of voltage, temperature, resistance, and power of the first lighting unit in operation;

encoding the first parameter and the first identification number with the first microprocessor into a first packet;

detecting a second parameter of one of voltage, temperature, resistance, and power of the second lighting unit in operation;

encoding the second parameter and the second identification number with the second microprocessor into a second packet;

sending the first packet to the second illuminating device;

sending the first and second packets from the second illuminating device to a control center via a network device, with the control center decoding the first and second packets and judging operational states of the first and second illuminating devices based on the first and second parameters detected;

sending a control signal by the control center through the network device to turn on or off or control brightness of at least one of the first and second illuminating devices when at least one of the first and second illuminating devices is judged as operating abnormally after judging the first and second parameters detected; and providing the control center with a plurality of operational modes corresponding to different brightnesses of each of the first and second illuminating devices, with sending the control signal including sending the control signal containing one of the plurality of operational modes to at least one of the first and second microprocessors, with providing the control center with the plurality of operational modes including providing the control center with the plurality of operational modes according to brightness requirements in different time periods, with sending the control signal including sending the control signal to turn off damaged first and second illuminating devices and to increase the brightness of undamaged first and second illuminating devices according to the brightness requirements in the different time periods.

14. The method as claimed in claim 13, with each of the first and second units including a spare lighting element unit, with sending the control signal including turning on the spare lighting element units when one or more of the plurality of lighting element units of the first and second lighting units are damaged.

15. The method as claimed in claim 14, further comprising: detecting the first and second parameters again; encoding the first parameter detected again and the first identification number into a third packet and sending the third packet to the second illuminating device; encoding the second parameter detected again and the second identification number into a fourth packet; sending the third and fourth packets to the control center to decode the third and fourth packets and judging the operational states of the first and second illuminating devices based on the first and second parameters detected again; and sending out an adjusting signal from the control center to at least one of the first and second illuminating devices to increase the brightness of at least one of the first and second lighting units when at least one of the first and second illuminated devices is judged as operating abnormally after judging first and second parameters detected again.

16. The method as claimed in claim 15, with sending out the adjusting signal including sending out the adjusting signal containing an identifying code to at least one of the first and second microprocessors, with the first microprocessor accepting the adjusting signal and adjusting brightness of the first illuminating device when the identifying code is identified to be the same as the first identification number, with the first microprocessor ignoring the adjusting signal when identifying code is identified to be not the same as the first identification number, with the second microprocessor accepting the adjusting signal and adjusting brightness of the second illuminating device when the identifying code is identified to be the same as the second identification number, with the second microprocessor ignoring the adjusting signal when identifying code is identified to be not the same as the second identification number.

* * * * *